US006439624B1

(12) United States Patent
Spurr

(10) Patent No.: US 6,439,624 B1
(45) Date of Patent: Aug. 27, 2002

(54) VEHICLE DOOR LOCK ACTUATOR

(75) Inventor: Nigel Victor Spurr, Birmingham (GB)

(73) Assignee: Meritor Light Vehicle Systems (UK) Limited (GB)

( * ) Notice: Subject to any disclaimer, the term of this patent is extended or adjusted under 35 U.S.C. 154(b) by 0 days.

(21) Appl. No.: 09/807,292

(22) PCT Filed: Oct. 8, 1999

(86) PCT No.: PCT/GB99/03346

§ 371 (c)(1),
(2), (4) Date: Apr. 10, 2001

(87) PCT Pub. No.: WO00/22264

PCT Pub. Date: Apr. 20, 2000

(30) Foreign Application Priority Data

Oct. 10, 1998 (GB) ..... 98220254

(51) Int. Cl.[7] ..... E05C 3/06
(52) U.S. Cl. ..... 292/201; 292/DIG. 23
(58) Field of Search ..... 292/216, 201, 292/DIG. 23; 70/264, 279.1, 282

(56) References Cited

U.S. PATENT DOCUMENTS 5,649,726 A * 7/1997 Rogers ..... 292/201
5,746,076 A * 5/1998 Inoue ..... 70/277
6,145,354 A * 11/2000 Kondo ..... 70/279.1
6,155,124 A * 12/2000 Wirths ..... 74/89.13

FOREIGN PATENT DOCUMENTS

GB 2 306 551 A 5/1997

OTHER PUBLICATIONS

International Search Report dated Mar. 15, 1999.

* cited by examiner

*Primary Examiner*—Gary Estremsky
(74) *Attorney, Agent, or Firm*—Carlson Gaskey & Olds

(57) ABSTRACT

A power actuator for shifting a vehicle door lock or other closure mechanism selectively between a locked condition and an unlocked condition by powered operation while also permitting manual operation with the actuator providing indexing of manual shifting between said conditions comprising: a) an operatively fixed housing; b) a motor driven driver annulus journalled in or on said mounting for powered rotation and having interior control formations, a first set of said formations being within first axial zone of the annulus and including spaced radially extending control notches separated by peripheral control lands, and a second set of said formations being within a second axial zone of the annulus and including a plurality of angularly spaced radially inwardly projecting camming lobes, each lobe being diametrically opposite but axially offset from a respective notch; c) an elongate index element movable within the annulus, a head part of said element carrying a drive formation co-acting with the second set of formations to transmit drive angularly displacing said element on powered rotation of the annulus and to provide said indexing by angular movement of said element relative to the stationary annulus during manual operation, and a tail part of said element carrying stop formation co-acting with the second set of control formations to regulate the displacement of the element relative to the annulus; and d) an output element coupled to the index element and to the mechanism in use to transmit one motion to the other characterised in that the tail part of the index element also carries a control projection co-acting with a control slot of the mounting extending radially of the axis of rotation of the annulus, said projection being offset further from head part of the index element than the stop formation whereby the index element can swing angularly about the axis of said projection but its tail part is otherwise constrained for displacement radially of the annulus only with the offsetting providing leverage through the stop formation to ensure appropriate alignment of interacting parts of the element and annulus in operation.

12 Claims, 4 Drawing Sheets

VEHICLE DOOR LOCK ACTUATOR

BACKGROUND OF THE INVENTION

This invention relates to power actuators for operating lock mechanisms of vehicle doors and other closures. Such power operated lock mechanisms commonly form part of a central locking system of the vehicle whereby locking or unlocking of some or all doors or other closures can be effected from a single control station actuated from within or outside the vehicle as by a coded infra-red or other remote input device. The lock mechanism and associated power actuator will provide for manual operation whereby the respective door can be locked and unlocked using a conventional interior sill button or other manually operated input. element, and, maybe, by manual operation of a cylinder or other key controlled exterior lock.

An advantageous form of power actuator is described and claimed in our British Patent Application No. 9521790.7 (230655 1) dated Oct. 24, 1995, said known type of actuator being hereinafter referred to as "our previous manual override power actuator".

SUMMARY OF THE INVENTION

The object of the present invention is to provide improvements in our previous manual override power actuator for more reliable performance, simplification of construction, and space saving by way of more compact arrangement.

According to the invention there is provided a power actuator for shifting a vehicle door lock or other closure mechanism selectively between a locked or other first condition and an unlocked or other second condition by powered operation while also permitting manual operation with the actuator providing positive indexing of manual shifting between said conditions, said actuator comprising:

a) an operatively fixed housing or other mounting;

b) a motor driven driver annulus journalled in or on said mounting for powered rotation and having interior control formations, a first set of said formations being within a first axial zone of the annulus and including spaced radially extending control notches separated by peripheral control lands, and a second set of said formations being within a second axial zone of the annulus and including a plurality of angularly spaced radially inwardly projecting camming lobes, each lobe being diametrally opposite but axially offset from a respective notch;

c) an elongate index element movable within the annulus, a head part of said element carrying a drive formation coacting with the first set of formations to transmit drive angularly displacing said element on powered rotation of the annulus and to provide said indexing by angular movement of said element relative to the stationary annulus during manual operation, and a tail part of said element carrying a stop formation coacting with the second set of control formations to regulate the displacement of the element relative to the annulus; and d) an output element coupled to the index element and to the mechanism in use to transmit motion one to the other: characterised in that the tail part of the index element also carries a control projection co-acting with a control slot of the mounting extending radially of the axis of rotation of the annulus, said projection being offset further from the head part of the index element than the stop formation whereby the index element can swing angularly about the axis of said projection but its tail part is otherwise constrained for displacement radially of the annulus only with the offsetting providing leverage through the stop formation to ensure appropriate alignment of interacting parts of the element and annulus in operation Conveniently the output element is a lever fulcrummed in or on the mounting and having one arm pivotally connected to the head part of the index element, for example directly engaged with an extension of the drive formation.

Preferably the index element is resiliently biased across the annulus in the general direction of the radially inner end of the control slot, for example in the case of the lever arm of the last preceding paragraph, by the drive formation extending into an elongate slot of the arm which also accommodates a spring urging said formation longitudinally of the arm.

The first set of control formations may be defined by a guide slot formation having a plurality, e.g. three, equiangularly spaced arms extending radially of the annulus from a common center to provide a plurality, e.g. three, camming lobes therebetween and the drive formation will conveniently pin in sliding engagement in said slot formation.

The second set of control formations may comprise near parallel sided notches opening radially through the annulus periphery corresponding in number to said lobes, and peripheral lands between said notches having curved radially inwardly directed faces, the spacing of the drive formation from the stop formation being such that the index element is prevented by whichever face is in opposing relationship to the stop formation from longitudinal displacement out of engagement with a first control formation intermediate its extremes of travel during powered driving movement, but the disposition of the notches being such that the index element is aligned for unobstructed displacement in effecting said indexing during manual operation.

BRIEF DESCRIPTION OF THE DRAWINGS

An example of the invention is now more particularly described with reference to the accompanying drawings wherein.

DETAILED DESCRIPTION OF THE PREFERRED EMBODIMENT

Figure 1:
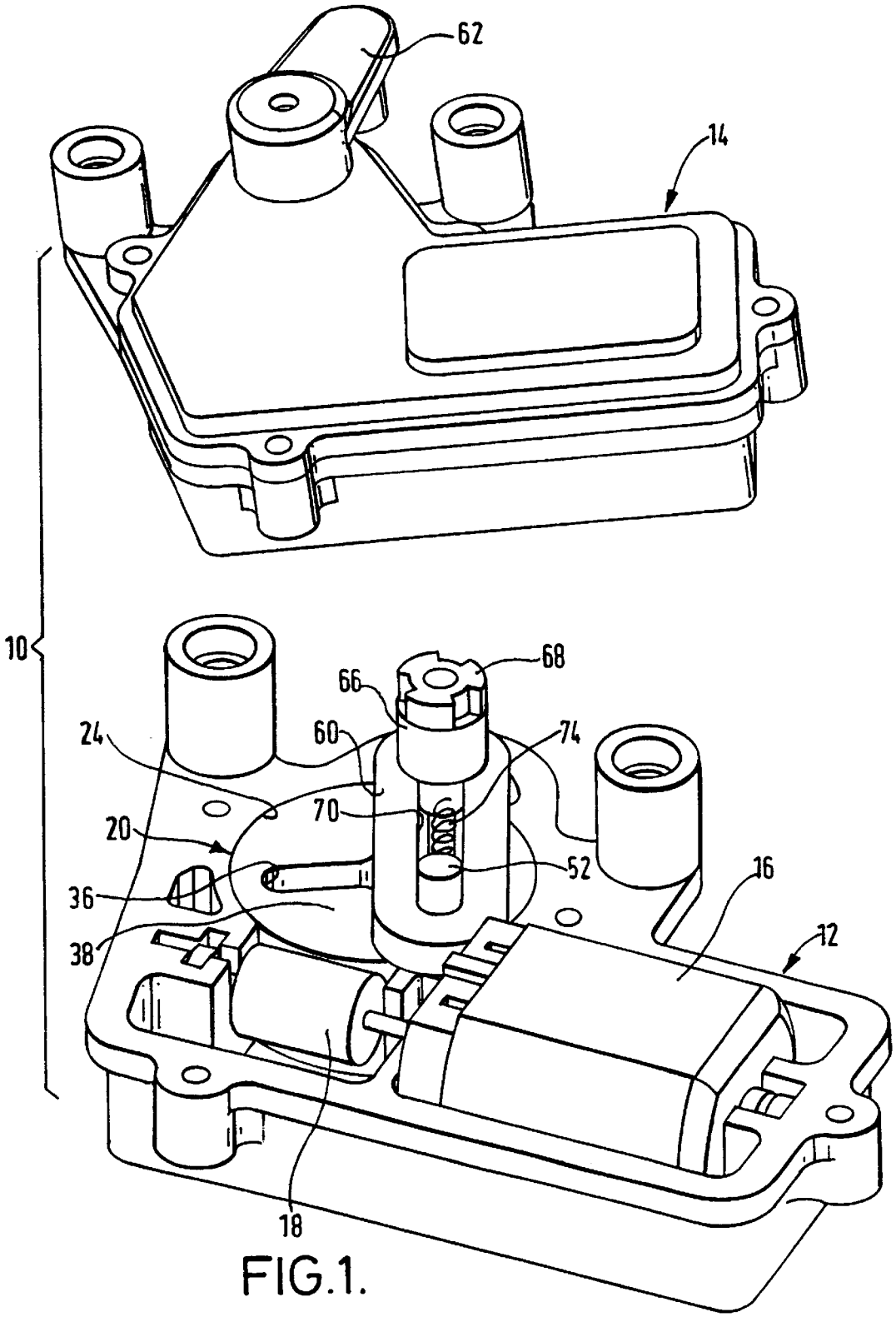
FIG. 1 is a part exploded perspective view of a vehicle door lock power actuator.

Power actuator 10 includes a housing base 12 which serves as a fixed mounting for other components and is provided with a mating cover 14. The housing contains an electric drive motor 16 having a worm pinion 18 on its output shaft.

Pinion 18 meshes with the externally toothed periphery of a driver annulus 20 received ina cylindrical recess 24 of base 12 locating it for rotation therein and retained against axial displacement following assembly by cover 14.

Annulus 20, best seen in FIGS. 3–5, has its internal shaping divided into two axial zones, a first axial zone 26, lowermost as viewed in the drawings, being provided with first interior control formations comprising equi-angularly spaced radial notches 28, in this example three in number each open to the bottom face of annulus 20 and also having radially outer ends open through the annulus periphery axially. below the externally toothed part engaged by pinion 18.

Each notch 28 has side walls which diverge very slightly from parallel in the radially outward direction and their inner ends are open to a central recess 29 of zone 26 defined by lands 30 between notches 28. Each land 30 has a curved radially inwardly directed face 32 struck on an arc centred in the respective diametrally opposite notch 28 at a radius somewhat greater than the radius of annulus 30.

Figure 3:
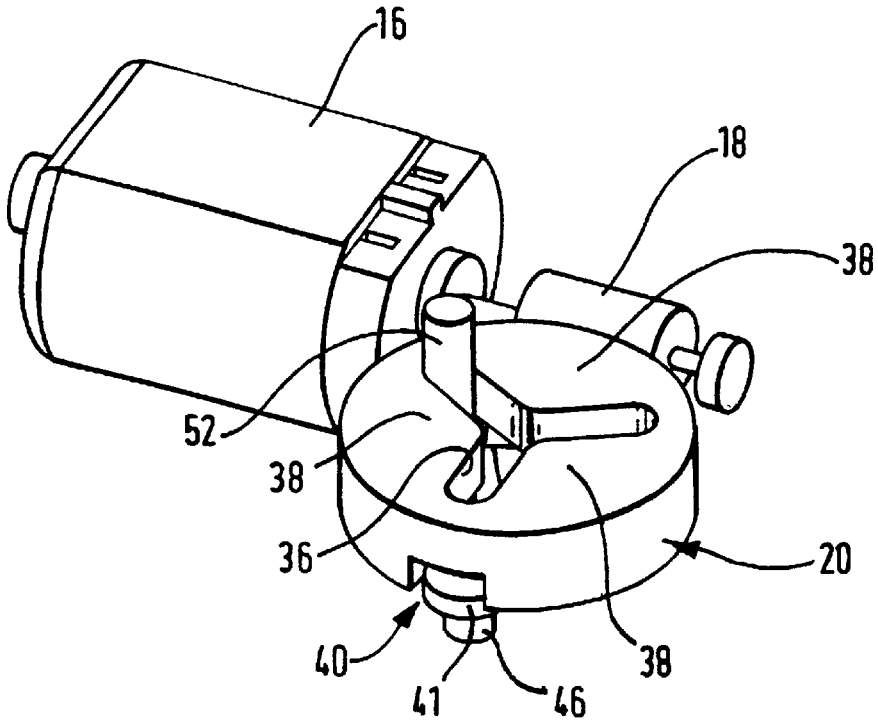
FIG. 3 is a detailed perspective view of parts of the actuator mechanism.
Figure 4:
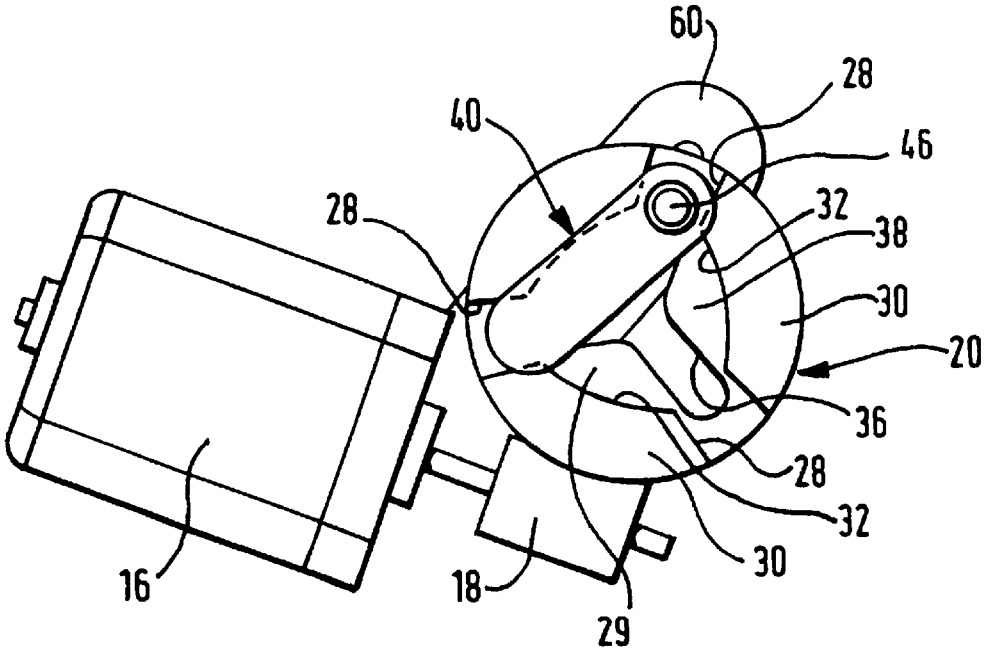
FIG. 4 is a diagrammatic underneath view of the latter parts.

The second axial zone 34 of annulus 20, uppermost as viewed in FIGS. 1 and 3 is provided with second interior control formations by a guide slot formation 35 having three arms extending equi-angularly from a common center, their distal ends terminating radially co-extensive with the radially inner end parts of notches 28. The arms have parallel side faces so that they define three camming lobes 38.

Figure 2:
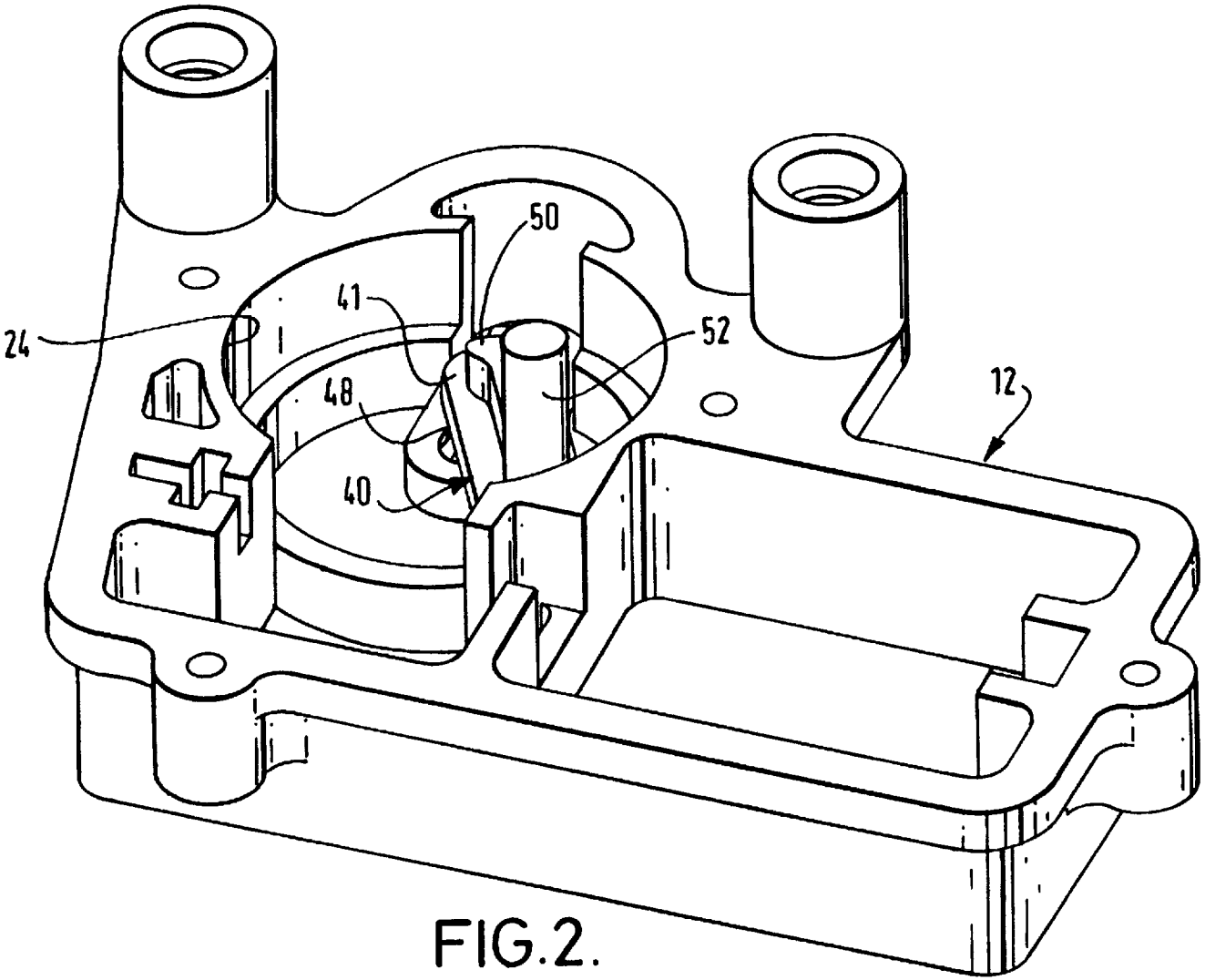
FIG. 2 is a like view with some parts removed.

Located within annulus 20 is an index element 40 guided for restricted floating movement relative to the annulus as further described below. Element 40 has an elongate body portion 41 shiftable within recess 24 of base 12 immediately below annulus 20, its tail end being provided with a downwardly directed control peg 46 received in a rectilinear control slot 48 (FIG. 2) in base 12 extending radially below annulus 20.

Said tail end also carries on its upper face an upwardly projecting stop peg 50 axially co-extensive with first zone 26 of annulus 20 so that it lies within recess 29 and/or grooves 28. Peg 50 is somewhat offset towards the head end of index element 40 relative to control peg 46. Stop peg 50 does not project axially (i.e. upwardly) beyond recess 29. The head end of element 40 carries an upwardly extending drive pin 52 which projects not only through the first axial zone 26 but also through second zone 34 being sized to be a running fit in guide slot formation 36, and to project above and beyond annulus 20 as best seen in FIGS. 1 and 3.

An output element in the form of a two-part bell crank lever 60,62 (FIG. 1) is fulcrummed on base 12 on an axis spaced from the same side of base recess 24 as is underlain by control slot 48. A journal portion 66 of first arm 60 of said lever includes a splined projection 68 which extends through cover 14 on assembly and mounts second arm 62 of the lever externally of the housing.

First arm 60 lies across the upper face of annulus 20 and is provided with a longitudinal slot 70 which is engaged by the upper end of index element drive pin 52. A compression spring 74 locates in slot 70 to bear on pin 52 resiliently urging it to the distal end of slot 70.

In use lever arm 62 will be linked to associated locking mechanism of the vehicle door or other closure. Said mechanism will also include provision for its manual operation, e.g. by an interior sill button of the door, in known manner for locking and unlocking, said operation causing angular displacement of the lever between first and second, i.e. locked and unlocked, positions, arm 60 being displaced to one side or the other of annulus 20 by said operation.

In the course of such manual displacement, pin 52 of index element 40 will ride or cam across whichever lobe 38 is positioned radially opposite the lever axis, compression spring 74 providing a snap-over indexing action as pin 52 passes from one arm of slot formation 36 to the other. Index element 40 is restrained to swing from one said arm to the other by the engagement of its control peg 46 in control slot 48.

As index element 40 swings from one position to the other under said manual operation of lever 60 the stop peg 50 is positioned in the radially inner end of whichever notch 28 is diametrally opposite the relevant lobe 38 so that it can move radially along said notch with the necessary degree of rotation without binding or. being obstructed by lands 30 in the first axial zone 26.

This manual operation can take place in either direction, and can also take place in an identical manner at any of the three rotational positions of rest of annulus 20.

If powered operation of the locking mechanism is to take place, motor 16 will be energised for drive in whichever direction is appropriate for the relevant change of condition, the system with which the actuator will be associated in use will include switches in known manner to detect and set the required sequence, so rotating annulus 20 in the direction required for movement of lever 60 from whichever position it is at to the other position.

Rotation of annulus 20 carries with it index element 40 by reason of the engagement of drive pin 52 at the radially outer end of one of the arms of the guide slot formation 36, swinging the index pivotally about the axis of control peg 46 located laterally in the fixed control slot 48. As annulus 20 rotates the arcuate face 32 of the land 30 which is diametrally opposite the relevant guide slot arm is carried in close proximity to stop peg 50 at the tail end of the index element blocking shifting of that element along control slot 48 and so ensuring that drive pin 52 remains engaged at its radially outward position in annulus 20. This ensures positive drive to the output element by way of lever arm 60.

Figure 5:
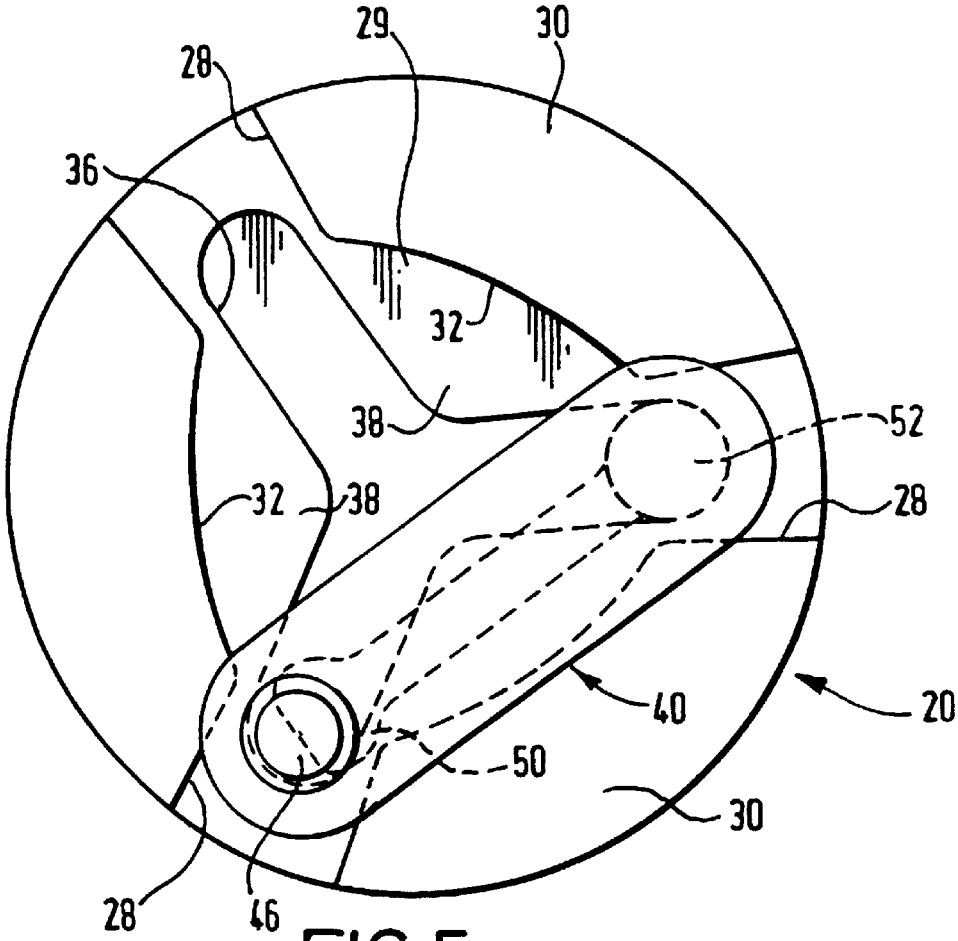
FIG. 5 is an enlarged diagrammatic underneath view of a driver annulus and index element of said mechanism.
Figure 6:
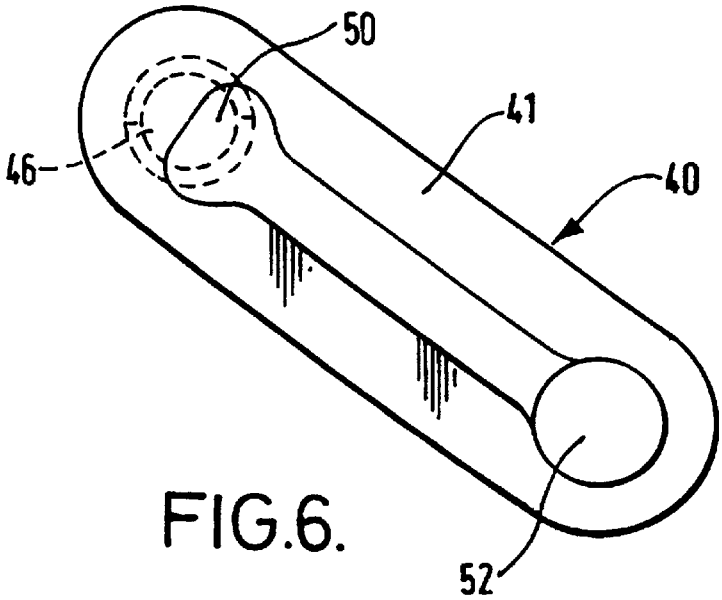
FIG. 6 is an enlarged plan view of the index element.

At the completion of a movement of annulus 20, turning it through 120 degrees, stop peg 50 will be positioned in the next radial notch 28, the extent of movement of annulus 20 being positively terminated by abutment of the trailing side of peg 50 with the comer of the next adjacent land 30 as best seen in FIG. 5.

A subsequent power operation can take place in the opposite direction in which case drive pin 52 remains in the same arm of formation 36, the same land 30 swings past stop peg 50 and the latter is returned to the previous radial notch 28.

If, instead of a subsequent power operation, the next operation is manual, movement of the output lever indexed will take place as described above shifting drive pin 52 to the next arm of slot formation 36.

The offset of stop peg 50 longitudinally of index element 40 relative to the control peg 46 ensures that manual operation can always take place without any misalignment of annulus 20 with the index element which could block transfer of drive pin 52 along the slot formation 36. The positioning of stop peg 50 ensures that it is placed to move radially outwardly into the relevant notch 28 without obstruction. If, for any reason, annulus 20 has not aligned exactly following power operation the offset will provide leverage through stop peg 50 as index element 40 commences angular displacement relative to annulus 20 to cam the side walls of the notch 28 to line the annulus up and ensure that said pin can move along the notch unobstructed.

The described arrangement does not require any provision of separate stop formations limiting angular motion of the index element 40 as was the case with our previous manual override power actuator, also the construction is much simpler and more compact then the latter and is much less likely to jam due to misalignment of moving components for the reasons referred to above. In particular a powered motion of annulus 20 will always terminate with stop peg 50 partly entered in the next radial notch 28 and with rotary movement of annulus 20 being positively blocked beyond that position even if some small misalignment has to be automatically corrected by the camming action referred to above. Thus one or more manual operations are always possible following any power operation.

As with our previous manual override power actuator no movement of annulus 20 and its power drive components takes place during manual operation, there is no back driving of a gear train or the like so avoiding noise and strain on the mechanism during manual operation, nor is there any need for a centrifugal, magnetic or other clutch in the power drive train. The resiliently loaded snap-over indexing on manual operation is provided without the need for extra components such as springloaded toggle mechanisms or over-centre devices. Furthermore during power operation there is no involvement of the resiliently loaded indexing function, as with our previous manual override power actuator the power drive does not have to overcome any springloading or the like and this reduces power demands,. uneven loading during a power cycle, and wear and tear.

While a three position annulus and index element combination have been described it is to be understood that for some applications four or more positions might be provided.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A power actuator for shifting a closure mechanism selectively between a first condition and a second condition by powered operation while also permitting manual operation with said actuator providing indexing of manual shifting between said conditions, said actuator comprising:

a) an operatively fixed housing;

b) a motor driven driver annulus journalled in or on said housing for powered rotation and having a plurality of interior control formations, a first set of said formations being within a first axial zone of said annulus and including a plurality of spaced radially extending control notches each separated by a peripheral control land, and a second set of said formations being within a second axial zone of said annulus and including a plurality of angularly spaced radially inwardly projecting camming lobes, each of said lobes being diametrically opposite but axially offset from a respective notch;

c) an elongate index element movable within said annulus, a head part of said element carrying a drive formation co-acting with said second set of formations to transmit drive angularly displacing said element on powered rotation of said annulus and to provide indexing by angular movement of said element relative to said stationary annulus during manual operation, and a tail part of said element carrying a stop formation co-acting with said first set of control formations to regulate displacement of said element relative to said annulus; and d) an output element coupled to said index element and to said mechanism in use to transmit motion one to the other wherein said tail part of said index element also carries a control projection co-acting with a control slot of said housing extending radially of an axis of rotation of said annulus, said projection being offset further from said head part of said index element than said stop formation whereby said index element can swing angularly about said axis of said projection but its said tail part is otherwise constrained for displacement radially of said annulus only with the offsetting providing leverage through said stop formation to ensure appropriate alignment of interacting parts of said element and said annulus in operation.

2. The actuator as recited in claim 1 wherein said output element is a lever fulcrumed in or on said housing and having an arm pivotally connected to said head part of said index element.

3. The actuator as recited in claim 2 wherein said lever arm is directly pivotally engaged with an extension of said index element drive formation.

4. The actuator as recited in claim 1 wherein said index element is resiliently biased across said annulus in a general direction of a radially inner end of said control slot.

5. The actuator as recited in claim 3 wherein said drive formation extends into an elongate slot of said arm which also accommodates a spring urging said formation longitudinally of said arm.

6. The actuator as recited in claim 1 wherein said second set of control formations is defined by a guide slot formation having a plurality of equi-angularly spaced arms extending radially of said annulus from a common center to provide a plurality of camming lobes there between, and in that said drive formation is a pin in sliding engagement in said slot formation.

7. The actuator as recited in claim 6 wherein there are three said arms and three camming lobes.

8. The actuator as recited in claim 6 wherein said first set of control formations includes near parallel sided notches opening radially through said annulus periphery corresponding in number to said lobes, and said peripheral lands between said notches having curved radially inwardly directed faces, the spacing of said drive formation from said stop formation being such that said index element is prevented by whichever face is in opposing relationship to said stop formation from longitudinal displacement out of engagement with a first control formation intermediate its extremes of travel during powered driving movement, but the disposition of said notches being such that said index element is aligned for unobstructed displacement in effecting said indexing during manual operation.

9. The power actuator as recited in claim 1, wherein said closure mechanism is a vehicle door lock.

10. The power actuator as recited in claim 1, wherein said first condition is a locked condition and said second condition is an unlocked position.

11. A vehicle door lock assembly comprising:

a power actuator for shifting a closure mechanism selectively between a first condition and a second condition by powered operation while also permitting manual operation with said actuator providing indexing of manual shifting between said conditions, said actuator including:

a) an operatively fixed housing;

b) a motor driven driver annulus journalled in or on said housing for powered rotation and having a plurality of interior control formations, a first set of said formations being within a first axial zone of said annulus and including a plurality of spaced radially extending control notches each separated by a peripheral control land, and a second set of said formations being within a second axial zone of said annulus and including a plurality of angularly spaced radially inwardly projecting camming lobes, each of said lobes being diametrically opposite but axially offset from a respective notch;

c) an elongate index element movable within said annulus, a head part of said element carrying a drive formation co-acting with said second set of formations to transmit drive angularly displacing said element on powered rotation of said annulus and to provide indexing by angular movement of said element relative to said stationary annulus during manual operation, and a tail part of said element carrying a stop formation co-acting with said first set of control formations to regulate displacement of said element relative to said annulus; and d) an output element coupled to said index element and to said mechanism in use to transmit motion one to the other wherein said tail part of said index element also carries a control projection co-acting with a control slot of said housing extending radially of an axis of rotation of said annulus, said projection being offset further from said head part of said index element than said stop formation whereby said index element can swing angularly about said axis of said projection but its said tail part is otherwise constrained for displacement radially of said annulus only with the offsetting providing leverage through said stop formation to ensure appropriate alignment of interacting parts of said element and said annulus in operation.

12. A vehicle body door comprising:

a power actuator for shifting a closure mechanism selectively between a first condition and a second condition by powered operation while also permitting manual operation with said actuator providing indexing of manual shifting between said conditions, said actuator including:

a) an operatively fixed housing;

b) a motor driven driver annulus journalled in or on said housing for powered rotation and having a plurality of interior control formations, a first set of said formations being within a first axial zone of said annulus and including a plurality of spaced radially extending control notches each separated by a peripheral control land, and a second set of said formations being within a second axial zone of said annulus and including a plurality of angularly spaced radially inwardly projecting camming lobes, each of said lobes being diametrically opposite but axially offset from a respective notch;

c) an elongate index element movable within said annulus, a head part of said element carrying a drive formation co-acting with said second set of formations to transmit drive angularly displacing said element on powered rotation of said annulus and to provide indexing by angular movement of said element relative to said stationary annulus during manual operation, and a tail part of said element carrying a stop formation co-acting with said first set of control formations to regulate displacement of said element relative to said annulus; and d) an output element coupled to said index element and to said mechanism in use to transmit motion one to the other wherein said tail part of said index element also carries a control projection co-acting with a control slot of said housing extending radially of an axis of rotation of said annulus, said projection being offset further from said head part of said index element than said stop formation whereby said index element can swing angularly about said axis of said projection but its said tail part is otherwise constrained for displacement radially of said annulus only with the offsetting providing leverage through said stop formation to ensure appropriate alignment of interacting parts of said element and said annulus in operation.

* * * * *